US005740502A

United States Patent [19]

Kobayashi et al.

[11] Patent Number: 5,740,502

[45] Date of Patent: Apr. 14, 1998

[54] IMAGE FORMING APPARATUS AND IMAGE FORMING METHOD FOR FORMING ADJACENT IMAGES

[75] Inventors: Tetsuya Kobayashi, Numazu; Takashi Kawana, Yokohama, both of Japan

[73] Assignee: Canon Kabushiki Kaisha, Tokyo, Japan

[21] Appl. No.: 588,422

[22] Filed: Jan. 18, 1996

[30] Foreign Application Priority Data

Jan. 19, 1995 [JP] Japan ..... 7-006413

[51] Int. Cl.[6] ..... G03G 15/01

[52] U.S. Cl. ..... 399/128; 399/156; 399/191; 399/231; 430/54

[58] Field of Search ..... 355/326 R, 327, 355/266, 268, 228, 229; 430/42, 43, 54; 358/532; 399/156, 157, 128, 191, 231

[56] References Cited

U.S. PATENT DOCUMENTS

| | | | |
|---|---|---|---|
| 4,627,703 | 12/1986 | Suzuki et al. | 355/268 X |
| 4,961,094 | 10/1990 | Yamaoki et al. | 355/326 R |
| 5,250,994 | 10/1993 | Ito et al. | 355/271 |
| 5,329,346 | 7/1994 | Suzuki et al. | 355/326 R |
| 5,459,557 | 10/1995 | Hasegawa et al. | 355/229 X |

FOREIGN PATENT DOCUMENTS

| | | | |
|---|---|---|---|
| 2607727 | 9/1976 | Germany . | |
| 50-50935 | 5/1975 | Japan . | |
| 50-93437 | 7/1975 | Japan . | |
| 60-53973 | 3/1985 | Japan | 355/268 |
| 63-303364 | 12/1988 | Japan | 355/268 |
| 6-250514 | 9/1994 | Japan | 355/327 |

*Primary Examiner*—Arthur T. Grimley
*Assistant Examiner*—Sophia S. Chen
*Attorney, Agent, or Firm*—Fitzpatrick, Cella, Harper & Scinto

[57] ABSTRACT

An image forming apparatus includes a photosensitive member; a charging member for charging the photosensitive member; an exposure device for exposing an image formation area of the photosensitive member charged by the charging member to light in accordance with an image signal to for an electrostatic image, and for exposing non-image-formation area around the image formation area to spots of light; and a developing device, having a developer carrying member for carrying a layer of developer having a thickness smaller than the gap with which the developer carrying member is opposed to the photosensitive member, for effecting reverse development of the electrostatic image.

10 Claims, 7 Drawing Sheets

IMAGE FORMING APPARATUS AND IMAGE FORMING METHOD FOR FORMING ADJACENT IMAGES

FIELD OF THE INVENTION

The present invention relates to an image forming apparatus such as a copying machine, a printer or the like, and an image forming method to be used therewith. In particular, it relates to a full-color image forming apparatus comprising plural development devices.

DESCRIPTION OF THE RELATED ART

In recent years, an apparatus for producing a color image has come to be widely used. This apparatus produces a color image by superimposingly transferring onto a sheet of recording paper, plural images developed on an photosensitive member through a charging step, an exposure step, and a development step. This type of apparatus has been proposed in German Laid-Open application No. 2,607,727, Japanese Laid-Open Patent Application No. 50,935/1975, and the like.

FIG. 8 is a sectional view of a full-color image forming apparatus on which the present invention is based.

As shown in the drawing, the apparatus comprises: a photosensitive drum 101, which constitutes an image bearing member; a roller type charger 122; plural development devices 119*a*, 119*b*, 119*c* and 119*d*, which are located on the left side of the photosensitive drum, and are supported by a supporting member 123, so that their corresponding development openings 124*a*, 124*b*, 124*c* and 124*d* can be made to face always in the direction of the photosensitive member 101; and a transfer drum 137, which is located on the right side of the photosensitive drum 101 to support a sheet of transfer material (unillustrated) and transfer the image formed on the photosensitive drum 1 onto the sheet of transfer material (unillustrated). With the provision of the structure described above, the photosensitive drum 101 is driven in the direction indicated by an arrow at a peripheral velocity of 100 mm/sec by unillustrated driving means. The photosensitive drum 101 is constituted of an aluminum cylinder having a diameter of 40 mm, and a layer of photoconductive material, for example, organic photoconductive material (OPC), coated on the peripheral surface of the cylinder. The OPC may be replaced by A-Si, CdS, Se or the like.

In the top portion of the apparatus, there are an optical unit 126 and a deflection mirror 127. The optical unit 126 constitutes the exposing device, and comprises: a laser diode, a rotary polygon mirror rotated by a high speed motor, and lenses. The surface of the photosensitive drum 101 is uniformly charged to approximately −700 V by the charge roller 122 to which a superimposed oscillating voltage composed of a DC voltage of −700 V, and an AC voltage having a frequency of 1,000 Hz and a peak-to-peak voltage (Vpp) of 1,500 V, is applied.

As an image signal, for example, a signal correspondent to a region of yellow color, is inputted to the laser diode, a laser beam is emitted from the laser diode. The emitted laser beam is projected to the photosensitive drum 101 along a light path 128. As the surface of the photosensitive drum 101 is exposed to the projected laser beam, the potential level of the exposed portion of the surface drops to approximately −100 V. As the photosensitive drum 101 is further rotated in the arrow direction, this potential level portion is visualized, for example, as a region of yellow color in this case, by the development device 119*a* containing yellow toner.

Next, the transfer step will be described in detail. The transfer drum 137 is constituted of a metallic cylinder 176 having a diameter of 156 mm, a 2 mm thick elastic layer coating the peripheral surface of the metallic cylinder 176, and a 100 μm thick PVDF (polyvinylidenefluoride) 178 laminated on the elastic layer 177. The elastic layer 177 in this case is formed of foamed urethane.

The transfer material fed from within a transfer material cassette 129 by a pick-up roller (unillustrated) is held first by a gripper 130, and then is electrostatically adhered to the transfer drum 137 by an adhesion roller 138 to which voltage is applied.

As voltage is applied to the transfer drum 137 from an unillustrated power source, the toner image on the photosensitive drum 101 is transferred onto the transfer material (unillustrated) having been adhered to the transfer drum 137.

The above described process is carried out for the rest of the colors: magenta, cyan, and black. As a result, a multicolor toner image is formed on the transfer material. Then, this transfer material is peeled from the transfer drum 137 by a separation claw 132, and is delivered to a known fixing device 133, in which the multi-color toner image is fused to the transfer material by heat and pressure, ending a cycle of color print production.

The residual toner, which is left on the photosensitive drum 101 after the toner image transfer, is removed by a known cleaning device 134 such as a fur brush, a cleaning blade, or the like. Then, the photosensitive drum 101 is discharged by a discharging device to be initialized. In the case of the image forming apparatus described at this time in which the charge roller 122 is used to charge the photosensitive drum 101, the photosensitive drum 101 is discharged by reducing the amount of the DC voltage to a voltage level of substantially 0 V while leaving the AC voltage as it is.

It is preferable that the residual toner on the transfer drum 137 is also cleaned as needed by a transfer drum cleaning device 135 constituted of a fur brush, a piece of web, or the like.

The transfer drum is discharged by a discharge roller 136 to be initialized.

As for the development system, the single component development system is preferable to the two component development system. This is because the latter requires a complex structure comprising an ART, a screw, and the like, for maintaining a predetermined ratio between the toner and carrier, whereas the former does not, and further, the former is usable with the process cartridge system which simplifies the maintenance to be performed by a user. Among various single component development systems, a non-contact type development system is preferable to a contact type development system, because in the case of the contact type development system, the development roller makes contact with the photosensitive drum, requiring one of them to be constituted of an elastic member. Conversely, in the case of the non-contact type development system, the thickness of the toner layer formed on the development roller is less than the gap formed between the development roller and the photosensitive roller, and the toner particles jump across this gap, allowing both members to be simply composed of aluminum or the like material without the need for surface modification. Therefore, the non-contact type system has merit in that it is simpler in structure, and costs less, than the contact type system.

Regarding the color toners, sharp-melt type toners, which instantly melt and mix at a predetermined fixing temperature, are preferable. However, the toners of this type tend to have a lower glass-transition temperature; therefore, when the photosensitive drum and the development roller are placed in contact, that is, when the contact type development system is employed, the toner is liable to fuse to one or both of the rollers as they rub against each other. Thus, the non-contact type development system is preferable also to prevent this toner fusion.

As is evident from the above description, the non-contact type development system has a number of advantages. However, the inventors of the present invention discovered that when a color image was formed using this system, a white gap, which did not exist in an original, was created between adjacent solid image regions of different colors as shown in FIG. 7. This is because in the case of a certain type of latent image, the drum surface potential level is drastically different between adjacent regions, that is, an image edge is present. When a latent image region surrounded by this image edge is developed with the development device, the resulting visual image region is slightly smaller than the original latent image region.

Further, the reproduction of a fine line, which is not a matter of great concern in the case of monocolor image formation, deteriorates.

When a conventional image forming apparatus, which has the shortcomings described above, is used to produce a color copy of an image in which a band of cyan color is placed in contact with a band of black color, an image such as the one illustrated in FIG. 7 is produced. That is, gaps are created between the cyan and black color band regions of the color copy, which are supposed to be directly in contact with each other. This is because the latent image regions correspondent to the cyan and black color band regions of the original are visualized (developed) as slightly smaller color band image regions as described above.

This image shrinkage occurs because the lines of the magnetic force are semicircularly bent, as illustrated in FIG. 4, above the edge portions of the electrostatic latent image formed on the photosensitive drum. The effects of this phenomenon are particularly conspicuous in the case of the noncontact type development system. One of the methods for reducing this semicircular bending of the magnetic field lines is to reduce the potential level to which the drum surface is uniformly charged. This method is effective to reduce the image shrinkage during the development process, but has the following shortcomings: the toner adheres to the areas where it is not supposed to (zero image region), generating so called fog; and also, a sufficient degree of image density cannot be obtained due to the reduced potential difference between the area where the toner is to adhere (solid image region) and the area to which it is not (zero image region).

SUMMARY OF THE INVENTION

Accordingly, the primary object of the present invention is to provide an image forming apparatus capable of preventing the image shrinkage which occurs when the latent image is visualized, and a method used therewith.

Another object of the present invention is to provide an image forming apparatus capable of preventing a gap from being created between adjacent image regions which are to be continuous.

According to an object of the present invention, there is provided an image forming apparatus, comprising: a photosensitive member; charging means for charging the photosensitive member; exposure means for exposing an image formation area of the photosensitive member charged by the charging means to light in accordance with an image signal to for an electrostatic image, and for exposing non-image-formation area around the image formation area to spots of light; and developing means, having a developer carrying member for carrying a layer of developer having a thickness smaller than the gap with which the developer carrying member is opposed to the photosensitive member, for effecting reverse development of the electrostatic image.

According to another aspect of the present invention, there is provided an image forming method, comprising the steps of: charging a photosensitive member; exposing a first image formation area of the photosensitive member charged by the charging means; exposing an area around the first image formation area with spots of light; reverse developing a first electrostatic image with a first one component toner; transferring the first toner image from the photosensitive member onto a recording material; recharging the photosensitive member; exposing to light a second image formation area of the photosensitive member adjacent to the first image formation area; reverse developing a second electrostatic image with a second toner; and transferring the second toner image from the photosensitive member onto the recording material having the first toner image.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
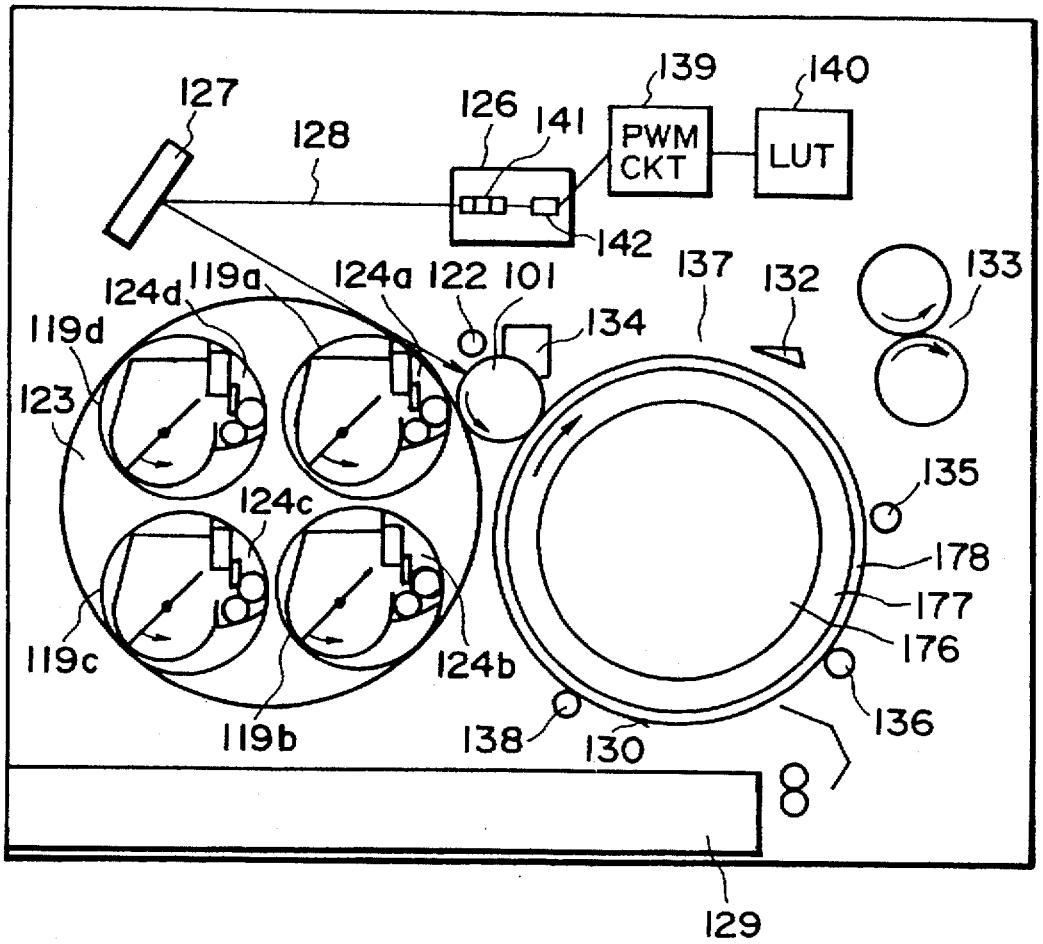
FIG. 1 is a sectional view of an image forming apparatus in an embodiment of the present invention.
Figure 2:
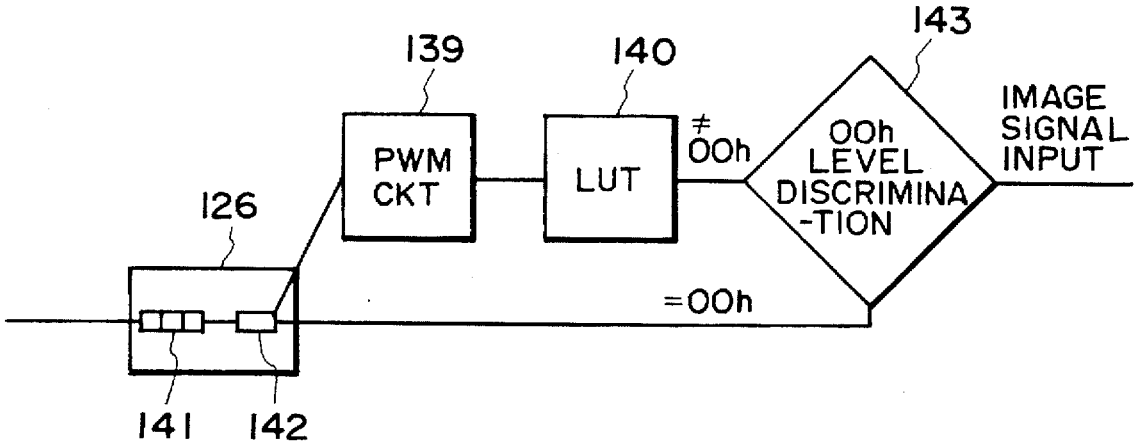
FIG. 2 is a block diagram for processing multi-level image signal.
Figure 9:
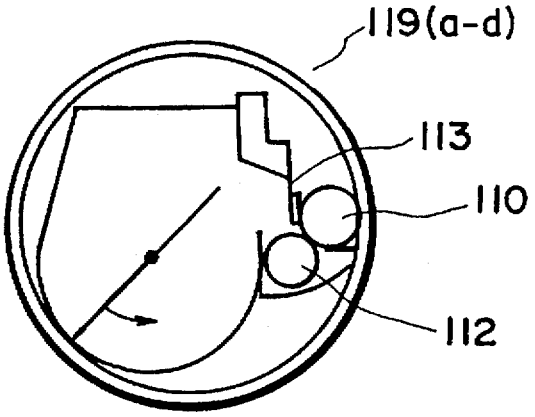
FIG. 9 is an enlarged section of a development device.

FIG. 1 is a sectional view of the electrophotographic full-color image forming apparatus in an embodiment of the present invention, and FIG. 9 is an enlarged section of a development apparatus.

Figure 8:
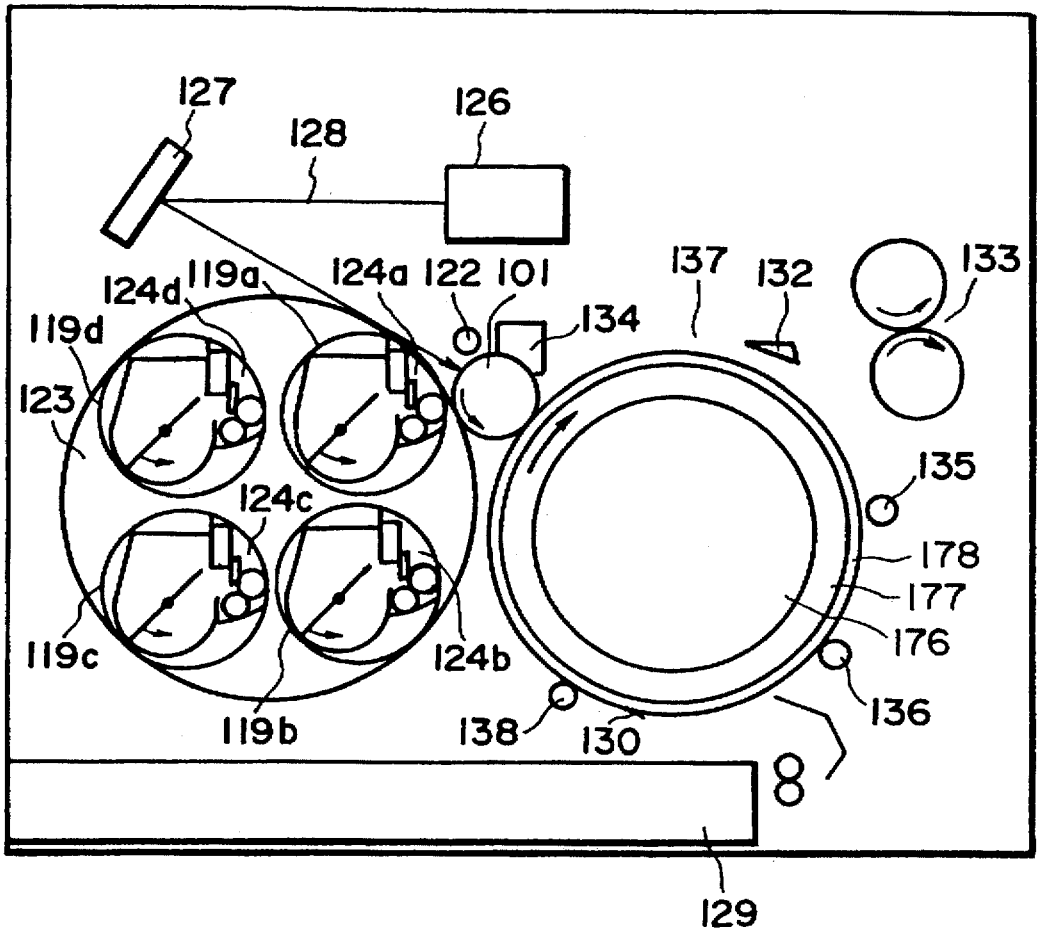
FIG. 8 is an image forming apparatus on which the present invention is based.

In these drawings, the members which are the same as those described with reference to FIG. 8 will be designated by the corresponding reference numerals, and their descriptions will be excluded.

Development devices 119*a*, 119*b*, 119*c* and 119*d* contain yellow, magenta, cyan and black toners, respectively. These toners are all nonmagnetic, single component toners.

Referring to FIG. 9, each development device comprises a coater roller 112, a toner regulating member 113, and a development roller 110. As the development roller 110 is rotated, the toner is coated on the development roller 110 by the coater roller 112, and then, necessary charge is triboelectrically given to the coated toner by the toner regulating member 113. When the toner is to be charged to the negative polarity, the toner regulating member 113 is preferably composed of nylon or the like material, and when the toner is to be charged to the positive polarity, the toner regulating member 113 is preferably composed of silicone rubber or the like; the material for the toner regulating member 113 is preferred to be such material that is charged to the polarity opposite to the polarity to which the toner is charged. As for the peripheral velocity of the development roller 110, it is preferably set within a range of 1.0 to 2.0 times that of the photosensitive drum 101. The development devices 119*a*, 119*b*, 119*c* and 119*d* mounted on the supporting member 123 are driven in such a manner that the development openings 124*a*, 124*b*, 124*c* and 124*d* of the corresponding development devices 119*a*, 119*b*, 119*c* and 119*d* always face in the direction of the photosensitive member. One of the means for driving them is described in detail in Japanese Laid-Open Patent Application No. 93,437/1975.

The thickness of the toner layer on the development roller 110 is regulated by the toner regulating member 113 so that it becomes less than the gap formed between the development roller 110 and the photosensitive drum 101. In the development station, an alternating electric field is formed between the development roller 110 and the photosensitive drum 101 so that the toner on the development roller 110 jumps to the photosensitive drum 101 to develop the latent image.

Figure 3:
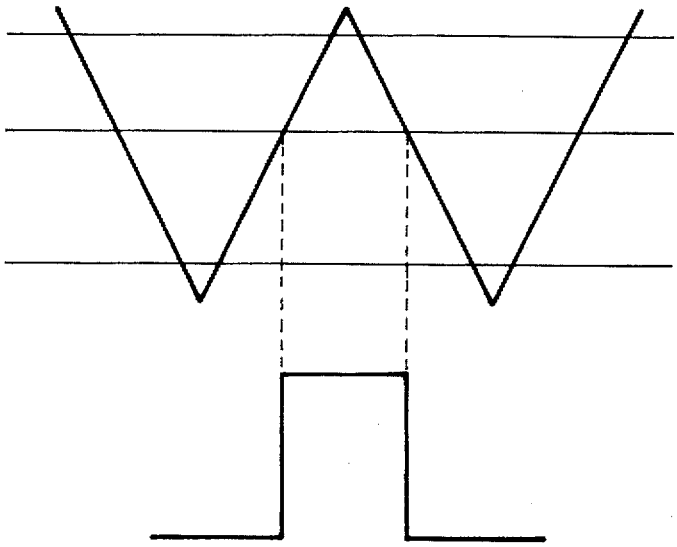
FIG. 3 depicts the pulse width modulation in accordance with the present invention.

The charged surface of the photosensitive drum 101 is exposed by the optical unit (or exposing device) 126 in response to the image signal. The image signal to be inputted to the exposing device is a multi-level signal carrying gradation data for a single picture element. This multi-level signal is sent through a look-up table (LUT) 140, which will be described later, and a PWM (pulse width modulation) circuit 139, to turn on a laser 142 which is the light source of the exposing device. At this time, referring to FIG. 3, the PWM circuit 139 will be described. It converts the multi-level signal, that is, digital data, into a voltage level through a D/A conversion process, and converts this voltage level into a reference triangular wave, to turn on the laser. The pulse-width-modulated laser beam is deflected by the polygon mirror 141 of the exposing device 126 to raster-scan the surface of the photosensitive drum 101. The size of the exposed area corresponds to the pulse width modulation. Generally speaking, the characteristics of the input and output of an image forming apparatus are intricately related to the photoconductive properties of the employed photosensitive drum 101, the spot diameter of the employed laser 142, the development characteristic, and the like factors; therefore, simply modulating the pulse width of the laser beam on the basis of the gradation data of the image signal is not enough to obtain desirable input/output characteristics, necessitating the correction by the LUT 140. Further, the desirable characteristics in this case means such characteristics that the density of a printed image is linearly related to the input data. In FIG. 3, a level 00h of the image signal does not coincide with the height of the vertex of the referential triangular wave. This is intentionally done in order to make the laser 142 emit a small amount of light in correspondence to the zero image regions.

Figure 4:
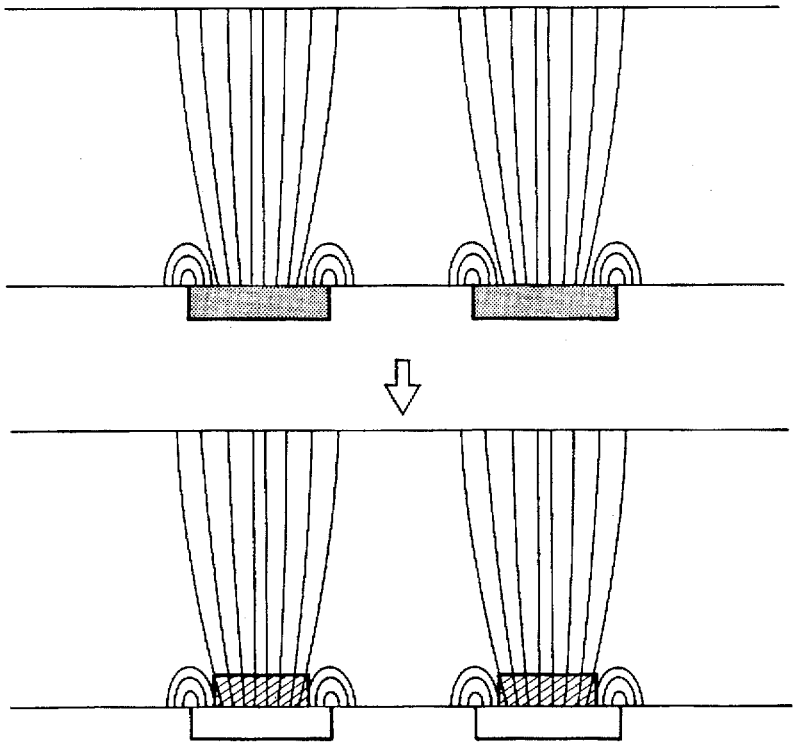
FIG. 4 depicts the image shrinkage which occurs during the visualization of the latent image.

Conventionally, in order to prevent the toner from adhering to the zero image regions, an input image signal discriminating means 143 is provided to prevent the laser 142 from being turned on when the level of the input image signal is 00h; when the input image signal level is at 00h, the laser 142 is directly driven to prevent it from being turned on, without involving the LUT 140 and the PWM circuit 139. However, the surface potential level changes steeply at the border between the solid image region and the zero image region (corresponding to the level 00h), and above this border, the electrical field lines are semicircularly bent as illustrated in FIG. 4, causing the image shrinkage; for example, when a color image is formed, gaps are created between the solid image regions of different color.

Figure 5:
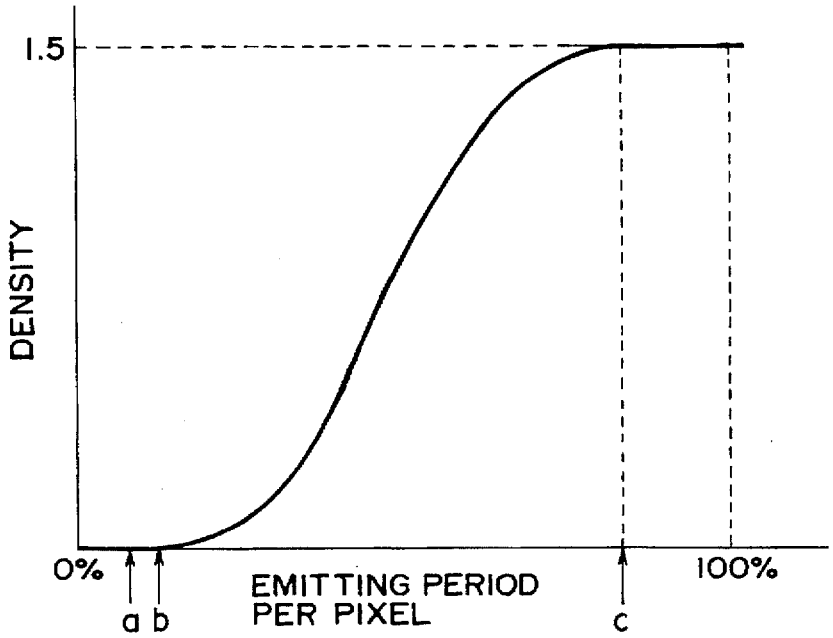
FIG. 5 shows the relationship between the duration of the laser beam emission, and the image density.
Figure 6:
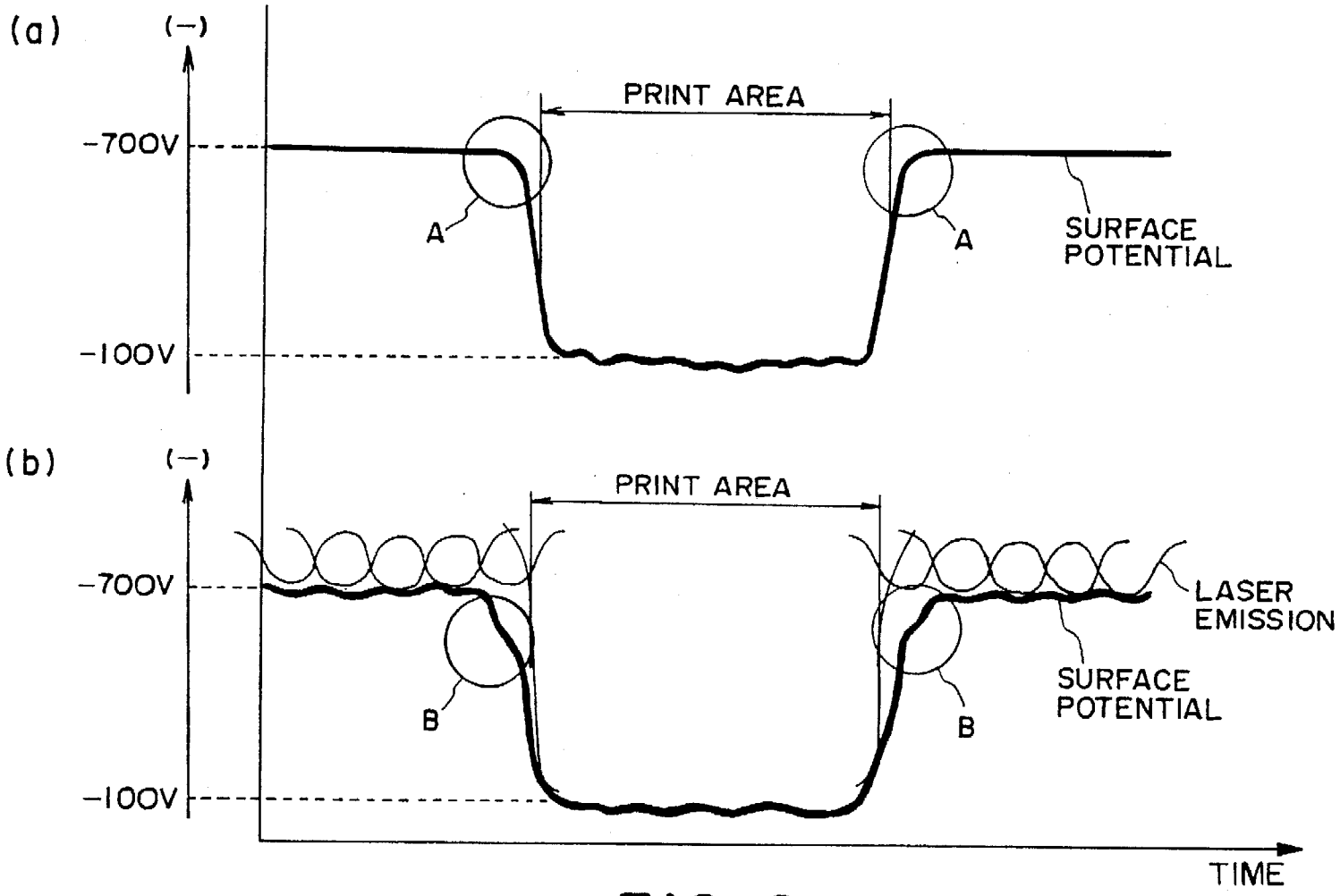
FIG. 6 schematically depicts the surface potential level difference.
Figure 7:
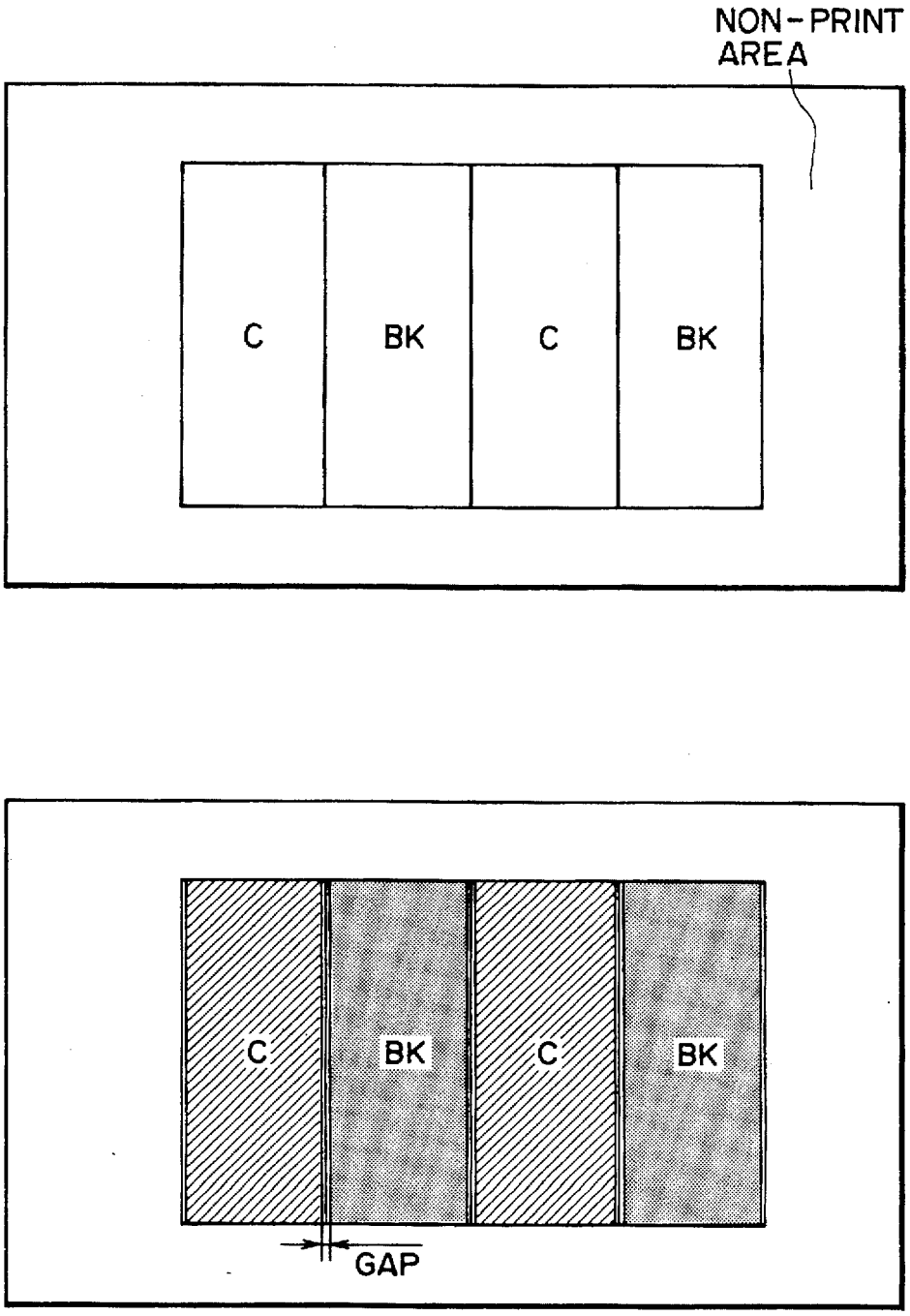
FIG. 7 depicts gaps between the adjacent solid color regions.

Conversely, in this embodiment, even when the image signal of the picture element data is at the level of 00h which corresponds to the zero image region, a slight amount of light is emitted from the laser to render the surface potential change less steep at the border between the solid image area and the zero image area, that is, to reduce the semicircular bending of the electrical field line at the border. As a result, the image shrinkage doe snot occur, and therefore, the gaps are not created between the solid image regions of different colors on the transfer material. FIG. 5 depicts the relationship between the duration of the laser beam emission, and the resulting image density. As is evident from FIG. 5, when the laser is turned on per picture element for a duration of 0% to 100%, the image density is not proportional to the duration. This is due to the aforementioned characteristics of the electrophotography. However, the image density changes in response to the duration of the light emission between points b and c where the directions of the light emission are b% and c%, respectively. Therefore, it is preferable to make the 00h level and a FFh level of the PWM circuit coincide with the b% and c%, respectively, of the light emission duration. It should be noted here that when the duration of the light emission is between 0% to b%, no image is created even though the laser is on. Therefore, it is possible to prevent the image shrinkage by turning on the laser for a predetermined duration within this range so that the steepness of the surface potential change at the aforementioned border on the photosensitive drum is reduced, that is, the potential level change is rendered gentler as depicted in FIG. 6(*b*). When this method is applied to a color image forming apparatus employing the non-contact type development system, no gap is created between the solid image regions of different colors. Referring to FIG. 5, the duration of the light emission in this embodiment is: a%=8%, b%=10%; and c%=90%.

FIG. 6 schematically depicts the surface potential level of the photosensitive drum 101. FIG. 6(*a*) represents the surface potential level when an image is conventionally formed. In this case, the potential levels correspondent to a solid image region and a zero image region are approximately −100 V and −700 V, respectively. In FIG. 6(*b*), the potential level on the solid image region is −100 V, and the average potential level on the zero image region is −700 V. In the condition illustrated in FIG. 6(*a*), in which the potential level changes steeply at the border (A portion) between the solid image region and the zero image region, the semicircular bending of the electric field lines is increased. However, when a minute amount of laser light is projected even across the zero image region as illustrated in FIG. 6(*b*), the potential level change at the border (B portion) between the solid image region and the zero image region becomes stepped, reducing the semicircular bending of the electric field lines.

Figure 10:
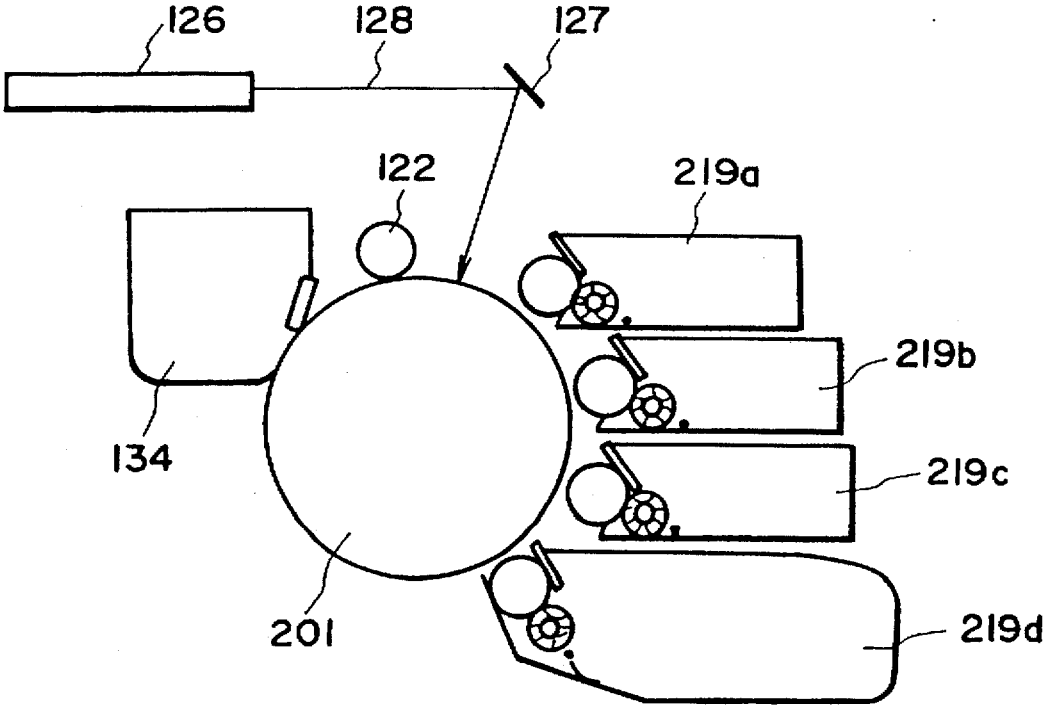
FIG. 10 is a schematic view of the image forming apparatus in another embodiment of the present invention.

FIG. 10 depicts the image forming apparatus in another embodiment of the present invention.

In this embodiment, non-contact type development devices 219*a*, 219*b*, 219*c* and 219*d* are fixedly disposed around a photosensitive drum 201; therefore, a color image can be formed without separating any of the development devices from the photosensitive drum 201.

In the preceding embodiments of the present invention, the present invention was described with reference to the laser scan system. It is obvious, however, that the same effects can be obtained using an exposing apparatus employing an LED array. Also, as the means for projecting a micro-dot of light, the method in which the duration of the light emission is varied using the pulse width modulation is described, but the same effects may be obtained using a system which modulates the intensity of the laser light.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a photosensitive member;

charging means for charging said photosensitive member;

exposure means for exposing an image formation area of said photosensitive member charged by said charging means with light in accordance with an image signal to form an electrostatic image;

developing means, having a developer carrying member for carrying a layer of developer having a thickness smaller than a gap between said developer carrying member and said photosensitive member, for effecting reverse development of the electrostatic image; and sub-exposure means for exposing with light a non-image-formation area of said photosensitive member, around the image formation area of said photosensitive member with light, not to be developed by said developing means.

2. An apparatus according to claim 1, wherein said developing means has a plurality of developing devices containing different color developers, and wherein said sub-exposure means exposes the area around said image formation area when an image having a portion where different colors are adjacent to each other is formed.

3. An apparatus according to claim 2, further comprising transfer means for transferring the developed image from said photosensitive member to a recording material.

4. An apparatus according to claim 2, wherein said apparatus is capable of forming a full-color image.

5. An apparatus according to claim 1, wherein said developer is a one component developer.

6. An apparatus according to claim 5, wherein said developer is a non-magnetic developer.

7. An apparatus according to claim 1, wherein said exposure means and said sub-exposure means have a common light source for emitting light modulated in accordance with the image signal.

8. An image forming method, comprising the steps of:

charging a photosensitive member;

exposing a first image formation area of the photosensitive member charged by said charging step;

exposing an area around said first image formation area with light, which is not to be developed;

reverse developing a first electrostatic image with a first one component toner;

transferring the first toner image from the photosensitive member onto a recording material;

recharging the photosensitive member;

exposing to light a second image formation area of the photosensitive member adjacent to the first image formation area;

reverse developing a second electrostatic image with a second toner; and transferring the second toner image from said photosensitive member onto the recording material having the first toner image.

9. A method according to claim 8, wherein the second toner is a one component toner, said method further comprising exposing an area around said second image formation area with light not to be developed.

10. A method according to claim 9, wherein first and second toners are non-magnetic.

* * * * *